US005847737A

United States Patent [19]

Kaufman et al.

[11] Patent Number: 5,847,737

[45] Date of Patent: Dec. 8, 1998

[54] FILTER FOR INK JET PRINTHEAD

[76] Inventors: Micah Abraham Kaufman, 577 Squires Rd., Lexington, Ky. 40515; Janine Marie Kelty, 150 Club La., Versailles, Ky. 40383; James Harold Powers, 4772 Rhema Way, Lexington, Ky. 40514; Michael Raulinaitis, 3656 Pheasant Run, Lexington, Ky. 40509; Lawrence Russell Steward, 1476 Mt. Ranier, Lexington, Ky. 40517

[21] Appl. No.: 665,707

[22] Filed: Jun. 18, 1996

[51] Int. Cl.[6] ..... B41J 21/175

[52] U.S. Cl. ..... 347/94; 347/65

[58] Field of Search ..... 347/93, 65, 92, 347/94

[56] References Cited

U.S. PATENT DOCUMENTS

| | | |
|---|---|---|
| 3,606,973 | 9/1971 | Davis . |
| 4,251,824 | 2/1981 | Hara et al. . |
| 4,380,770 | 4/1983 | Maruyama . |
| 4,394,670 | 7/1983 | Sugitani et al. . |
| 4,437,100 | 3/1984 | Sugitani et al. . |
| 4,490,728 | 12/1984 | Vaught et al. . |
| 4,509,063 | 4/1985 | Sugitani et al. . |
| 4,635,077 | 1/1987 | Itoh . |
| 4,639,748 | 1/1987 | Drake et al. . |
| 4,683,481 | 7/1987 | Johnson . |
| 4,698,645 | 10/1987 | Inamoto . |
| 4,719,479 | 1/1988 | Kyogoku . |
| 4,835,553 | 5/1989 | Torpey et al. . |
| 4,864,329 | 9/1989 | Kneezel et al. . |
| 4,875,059 | 10/1989 | Masuda . |
| 4,882,595 | 11/1989 | Trueba et al. . |
| 4,894,664 | 1/1990 | Tsung Pan . |
| 4,899,181 | 2/1990 | Hawkins et al. . |
| 4,980,703 | 12/1990 | Sakurai . |
| 5,016,024 | 5/1991 | Lam et al. . |
| 5,041,844 | 8/1991 | Deshpande . |
| 5,097,275 | 3/1992 | Takita . |
| 5,107,281 | 4/1992 | Takahashi . |
| 5,124,717 | 6/1992 | Campanelli et al. . |
| 5,132,707 | 7/1992 | O'Neill . |
| 5,141,596 | 8/1992 | Hawkins et al. . |
| 5,154,815 | 10/1992 | O'Neill . |
| 5,198,834 | 3/1993 | Childers et al. . |
| 5,204,690 | 4/1993 | Lorenze, Jr. et al. . |
| 5,296,875 | 3/1994 | Suda . |
| 5,317,346 | 5/1994 | Garcia . |
| 5,368,683 | 11/1994 | Altavela et al. . |
| 5,387,314 | 2/1995 | Baughman et al. . |
| 5,408,738 | 4/1995 | Schantz et al. . |

(List continued on next page.)

FOREIGN PATENT DOCUMENTS

| | | | |
|---|---|---|---|
| 0 314 486 A2 | 5/1989 | European Pat. Off. | B41J 3/04 |
| 314486 | 5/1989 | European Pat. Off. | B41J 3/04 |
| 0 500 068 A2 | 2/1992 | European Pat. Off. | B41J 2/175 |
| 0 500 068 A2 | 8/1992 | European Pat. Off. | B41J 2/175 |
| 0 627 318 A1 | 12/1994 | European Pat. Off. | B41J 2/175 |
| 0 670 221 A2 | 9/1995 | European Pat. Off. | B41J 2/16 |
| 55-100169 | 7/1980 | Japan | B41J 3/04 |
| 61-16864 | 1/1986 | Japan | B41J 3/04 |
| 3-202352 | 4/1991 | Japan | B41J 2/05 |
| 03202352 | 9/1991 | Japan | B41J 2/05 |
| 04265752 | 9/1992 | Japan | B41J 2/16 |
| 05004348 | 1/1993 | Japan | B41J 2/16 |
| 07266553 | 10/1995 | Japan | B41J 2/045 |

*Primary Examiner*—Joseph Hartary
*Attorney, Agent, or Firm*—John J. McArdle, Jr.

[57] ABSTRACT

An ink jet printhead includes a chip layer having a via for receiving ink, and having at least one actuator. A barrier layer is disposed adjacent the chip layer, and forms at least one throat which has a width and a cross-sectional area. The barrier layer also forms at least one bubble chamber, with each throat adapted to receive ink from the via and provide it to the respective bubble chamber. A nozzle layer is disposed adjacent the barrier layer, opposite the chip layer, and forms at least one nozzle for ejecting ink from the respective bubble chamber when the ink is energized by the associated actuator. At least one post is disposed proximate the throat, and extends part way between the chip layer and the nozzle layer. The post forms one or more gates through which the ink must pass from the via to the at least one throat.

6 Claims, 2 Drawing Sheets

U.S. PATENT DOCUMENTS 5,412,412 5/1995 Drake et al. .
5,441,593 8/1995 Baughman et al. .
5,443,713 8/1995 Hindman .
5,450,108 9/1995 Drake et al. .
5,450,113 9/1995 Childers et al. .
5,455,613 10/1995 Canfield et al. .
5,463,413 10/1995 Ho et al. ..... 347/65
5,469,199 11/1995 Allen et al. .
5,489,930 2/1996 Anderson .
5,519,424 5/1996 Scardovi et al. ..... 347/65
5,666,143 9/1997 Burke ..... 347/65

FILTER FOR INK JET PRINTHEAD

FIELD OF THE INVENTION

This invention relates to the field of ink jet print heads. More particularly the invention relates to the field of integrated ink filtration for ink jet print heads.

BACKGROUND OF THE INVENTION

As the several technologies which are combined to produce ink jet printheads have advanced, printheads capable of printing with increasingly finer resolution have been developed. As a part of this development, the geometries of the printhead have been reduced. As a result, problems that were previously insignificant have become serious detractions in printhead reliability.

For example, when printheads had larger geometries, debris in the ink was able to more easily pass through the different parts of the ink jet printhead, eventually passing out of the printhead through the nozzle without creating a problem. Now, however, several of the parts within a printhead are too narrow to allow the debris to pass, and so become clogged. The clogging may result in a nozzle which can no longer receive ink, thus impacting the print quality of the printhead.

Filters of various different configurations have been used to attempt to catch the debris before it encounters a part within the printhead that is too narrow for the debris to pass. Unfortunately, such filters typically either add expensive additional processing steps to the manufacture of the printhead, or produce more resistance to the flow of ink than is necessary to perform the function of filtering, thus creating other problems with the use of the filter.

What is needed, therefore, is a filter for an ink jet printhead that is easy and inexpensive to integrate with the manufacture of the printhead, and which does not unduly inhibit the flow of ink through the printhead.

SUMMARY OF THE INVENTION

The above and other objects are met by an ink jet printhead which has a via for receiving ink, and which has at least one actuator for energizing the ink. A barrier layer is disposed adjacent a chip layer, and it forms at least one throat which has a width and a cross-sectional area. The barrier layer also forms at least one bubble chamber, with the throat adapted to receive the ink from the via and provide it to the bubble chamber.

A nozzle layer is disposed adjacent the barrier layer, opposite the chip layer, and forms at least one nozzle for ejecting the ink from the bubble chamber when the ink is energized by the actuator. The post is disposed proximate the throat, and extends part way between the chip layer and the nozzle layer. While flowing from the via to the throat, the ink may pass through gates, defined in part by the post. The ink may also pass from the via, over the post, to the throat. In preferred embodiments the post further comprises a plurality of posts.

In preferred embodiments each gate has a width that is equal to or greater than the width of throat, and the gates have a summed cross-sectional area that is equal to or greater than a sum of the cross-sectional area of all of the at least one throat. In other words, in the case were there are more than one throat, the summed cross-sectional area of the gates is equal to or greater than the summed cross-sectional area of all of the throats. The post may extend either from adjacent the chip layer toward, but not to, the nozzle layer, or from adjacent the nozzle layer toward, but not to, the chip layer.

In a further preferred embodiment, at least one pillar is disposed proximate the throat, and extends from adjacent the nozzle layer toward, but not to, the chip layer. The post extends from adjacent the chip layer, and the pillar and post are interdigitated, or in other words, in the case where there are more than one post, or more than one pillar, the pillars and posts alternate one between the other. In yet further preferred embodiments the at least one post comprises a plurality of posts, and the at least one pillar comprises a plurality of pillars.

In an alternate embodiment the post forms a dam disposed proximate the throat, extending part way between the chip layer and the nozzle layer. The dam terminates at a free edge and forms a gate (between the free edge and an opposing layer) through which the ink must pass from the via to the throat. In preferred embodiments of this alternate embodiment, the gate has a height (the distance from the free edge to the opposing layer) that is equal to or greater than the width of the throat, and the gate has a cross-sectional area that is equal to or greater than a sum of the cross-sectional area of all of the at least one throat. The dam may extend either from adjacent the chip layer toward, but not to, the nozzle layer, or from adjacent the nozzle layer toward, but not to, the chip layer.

In a further alternate embodiment, a fluid filtering apparatus is provided. The fluid filtering apparatus may, for example, be positioned upstream of a printhead. A base layer forms a via for receiving a fluid, and a barrier layer is disposed adjacent the base layer, forming at least one throat having a width and a cross-sectional area. The throat is adapted to receive the fluid from the via. A cover layer is disposed adjacent the barrier layer, opposite the base layer. At least one post is disposed proximate the throat, between the via and the throat, and it extends part way between the base layer and the cover layer, and forms gates through which the fluid must pass from the via to the throat.

In variations of this further alternate embodiment, the post extends either from adjacent the base layer toward, but not to, the cover layer, or from adjacent the cover layer toward, but not to, the base layer. Preferably, the at least one post further comprises a first post extending from adjacent the base layer toward, but not to, the cover layer, and a second post extending from adjacent the cover layer toward, but not to, the base layer.

Thus, in these further alternate embodiments, the base layer is similar to the chip layer of other embodiments, but does not have an actuator, and may be formed of different materials. The cover layer is similar to the nozzle layer of other embodiments, but does not have a nozzle. Also in these embodiments, the barrier layer and the cover layer may be integrally formed of a single piece of material.

In all embodiments, the gate or gates allow the ink to pass from the via and eventually through the nozzle, but inhibits debris from passing into the throat, which is typically narrower than the bubble chamber, and clogging the throat. The gates are not necessarily narrower than the throat, but may either be as wide or wider than the throat, as this tends to be sufficient to keep the throat from clogging with debris. The post and pillar need not extend completely between the chip layer and the nozzle layer, as effective filtering may be realized without doing so, and a greater cross-sectional area is thereby provided for the ink to flow through.

BRIEF DESCRIPTION OF THE DRAWINGS

Further advantages of the invention will become apparent by reference to the detailed description of preferred embodiments when considered in conjunction with the following drawings, which are not to scale so as to better show the detail, in which like reference numerals denote like elements throughout the several views, and wherein.

DETAILED DESCRIPTION OF THE INVENTION

Figure 1:
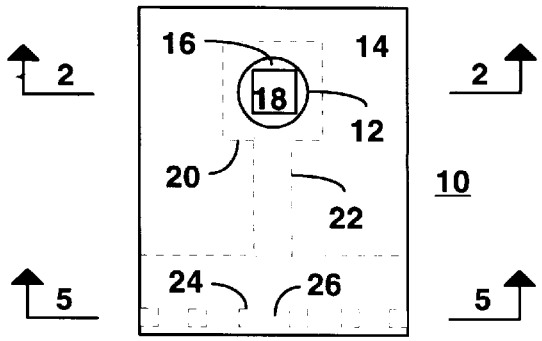
FIG. 1 is a top plan view of a portion of an ink jet printhead.

Referring now to the figures, there is depicted in FIG. 1 a top plan view of a portion of an ink jet printhead 10. In this view, nozzle layer 14 is on top, and chip layer 16 is visible through the nozzle 12 that is formed in nozzle layer 14. Also visible through nozzle 12 is actuator 18, which in different embodiments may be, for example, a thermal heater or a piezoelectric element. The actuator 18 is within bubble chamber 20, which is depicted in phantom lines, which is formed in the barrier layer between the nozzle layer 14 and the chip layer 16. Also formed in the barrier layer is a throat 22, which connects to bubble chamber 20.

During operation of the printhead 10, ink is brought through throat 22 and into bubble chamber 20, where it energized with actuator 18, such as being rapidly heated with a heater. The expansion of the ink when it is energized expels a portion of the ink from bubble chamber 20 through nozzle 12 and out of the printhead 10 onto a substrate. Printhead 10 typically has many of the throat 22, bubble chamber 20, actuator 18, nozzle 12 combinations, rather than just the one that is depicted in FIG. 1.

Figure 2A:
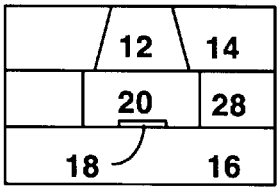
FIG. 2A is a cross-sectional view of a first embodiment of a bubble chamber.
Figure 2B:
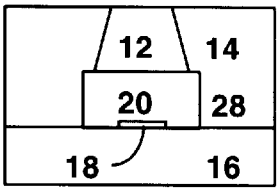
FIG. 2B is a cross-sectional view of a second embodiment of a bubble chamber.

FIG. 2A is a cross-sectional view of a first embodiment of the bubble chamber 20, which allows the barrier layer 28 to be seen between the nozzle layer 14 and the chip layer 16. There is depicted in FIG. 2B a cross-sectional view of a second embodiment of the bubble chamber 20, in which the nozzle layer 14 and the barrier layer 28 are integrally formed from a single piece of common material, such as a plastic. This combined nozzle layer 14—barrier layer 28 may be formed by a process such as laser ablation.

Referring again to FIG. 1, there are also depicted posts 24, which form gates 26. The posts 24 are also depicted in phantom, as they are also formed of material between the chip layer 16 and the nozzle layer 14. The posts 24 serve as filter elements to filter the ink before it flows into throat 22, so that any debris that may be in the ink is not trapped in throat 22, which might cause it to clog.

Figure 3:
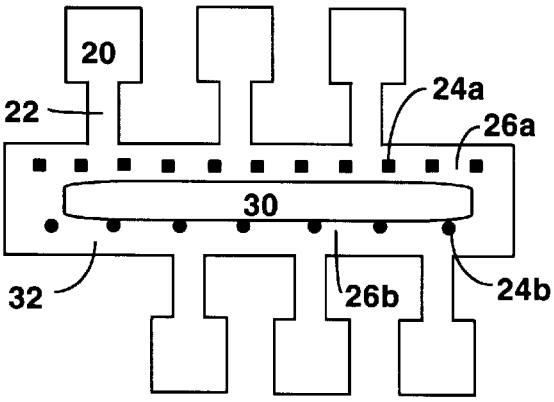
FIG. 3 is a top plan view of an ink jet printhead showing posts.

FIG. 3 is a top plan view of a greater portion of printhead 10, showing several bubble chambers 20 connected by throats 22 to an ink plenum 32. While only six such bubble chambers 20 are depicted in FIG. 3, it will be appreciated that typical printheads 10 will have many more such bubble chambers 20. The nozzle layer 14, depicted in FIGS. 1 and 2, has not been depicted in FIG. 3. In the chip layer 16 there is formed a via 30, through which the ink flows into the plenum 32, and then into the throats 22 and bubble chambers 20. An arrangement of posts 24*a* can be seen in this view.

As depicted in FIG. 3, the posts 24*a* form gates 26*a*, where the width of the gates 26*a* is equal to the width of the throats 22. Also as depicted in FIG. 3, the total cross-sectional area of the gates 26*a* is greater than the sum of the cross-sectional areas of the throats 22. In this example the posts 24*a* are rectangular in shape. Also, the posts 24*a* are set back somewhat from the edge of the via 30 through which ink is received.

There is also depicted in FIG. 3 a series of posts 24*b*. The posts 24*b* also form gates 26*b*, through which the ink flows to get from the via 30 to the throats 22. In this example the posts 24*b* are depicted as circular in shape. However, it will be appreciated that even though posts 24*a* are depicted as rectangular, and posts 24*b* are depicted as circular, the posts 24 may be of any shape.

The posts 24*b* are not set back from the edge of the via 30, as are the posts 24*a*, but are instead set right at the edge of the via 30. Also, the gates 26*b* formed by the posts 24*b* have a width that is greater than the width of the throats 22.

Traditional technology teaches that the space between filter elements, such as gates 26, must be narrower than the narrowest element of the printhead 10, which is typically the throat 22. However, it has been found that by forming gates 26 that are equal to or wider than the width of the throats 22, that any debris which may be in the ink is still effectually stopped or repelled by the posts 24. In addition, because the gates 26 may thus be wider than previously believed, the ink is allowed to pass through the filter elements with less resistance, thereby causing fewer problems associated with ink transport within the printhead 10.

The posts 24 are preferably disposed proximate the throats 22, but at the edge of the via 30, such as are posts 24*b*, rather than being set back from the edge of the via 30, such as posts 24*a*. By so doing, any debris stopped by the posts 24 may tend to remain in the via 30, and not stay trapped against the posts 24, and blocking a gate 26.

Figure 4:
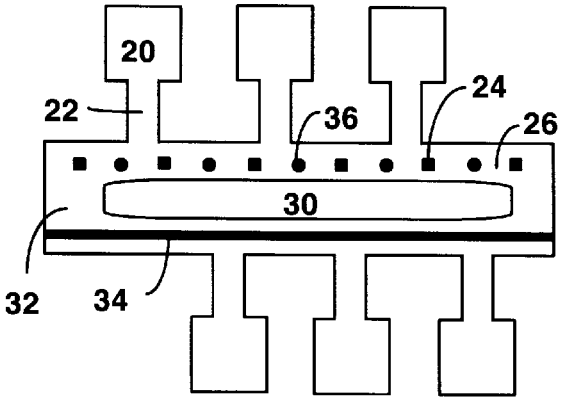
FIG. 4 is a top plan view of an ink jet printhead showing interdigitated posts and pillars, and a dam.

In FIG. 4 there is depicted a dam 34 which forms the filter element of this embodiment. Dam 34, as depicted in FIG. 4, extends from one end of the ink plenum 32 to the other. However, in alternate embodiments, dam 34 may form a gate 26 at one or both ends of the plenum 32, which gate 26 may be as wide or wider than the width of the throats 22, as explained above. Dam 34 also forms another gate 26 which is not visible in FIG. 4, but which will be explained in greater detail hereafter.

Also depicted in FIG. 4 are posts 24 which are interdigitated with pillars 36. The distinction between posts 24 and pillars 36 will be described in greater detail hereafter. As depicted, the posts 24 have a rectangular shape and the pillars 36 have a circular shape. However, as mentioned above, the shape of both the posts 24 and the pillars 36 may be of any shape which is convenient to form during the manufacturing process. Again, the gates 26 formed between the posts 24 and pillars 36 may be as wide or wider than the throats 22.

Figure 5A:
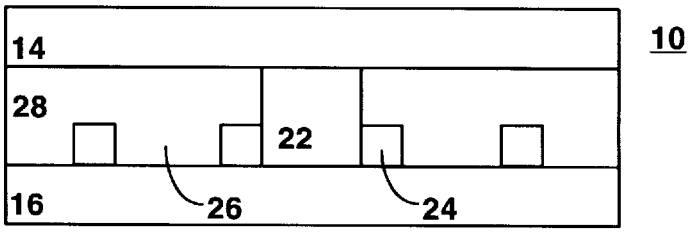
FIG. 5A is a cross-sectional view of a first embodiment of posts.

FIG. 5A depicts a cross-sectional view of printhead 10, showing additional important aspects of the posts 24. As can be seen, the posts 24 in this embodiment do not extend completely from the chip layer 16 to the nozzle layer 14, but instead extend for only a portion of the thickness of the barrier layer 28. In this embodiment the posts 24 extend from adjacent the chip layer 16. The gates 26 that are formed by the posts 24 are equal in width to the throat 22.

Figure 5B:
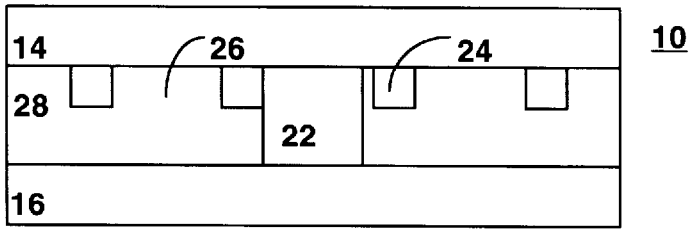
FIG. 5B is a cross-sectional view of a second embodiment of posts.

In the embodiment of FIG. 5B the posts 24 extend from adjacent the nozzle layer 14 toward, but not to, the chip layer 16. Also in this embodiment the gates 26 which are formed by the posts 24 have a width that is greater than throats 22.

Figure 5C:
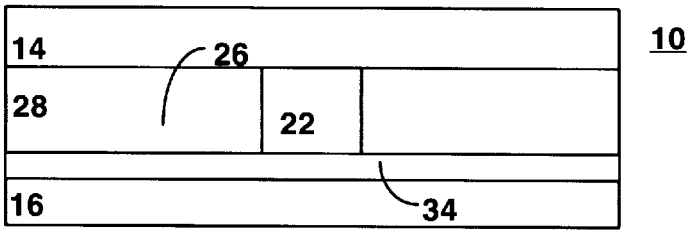
FIG. 5C is a cross-sectional view of a first embodiment of a dam.

FIG. 5C is a cross-sectional view of a first embodiment of the dam 34. In this embodiment the dam 34 extends from adjacent the chip layer 16 toward, but not to, the nozzle layer 12. The dam 34 forms a gate 26 between the top of the dam 34 and the nozzle layer 14. The gate 26 as depicted in this embodiment is equal in height (the distance from the dam 34 to nozzle layer 14) to the width of the throats 22, which is the horizontal dimension of throat 22 as shown in FIG. 5C.

Figure 5D:
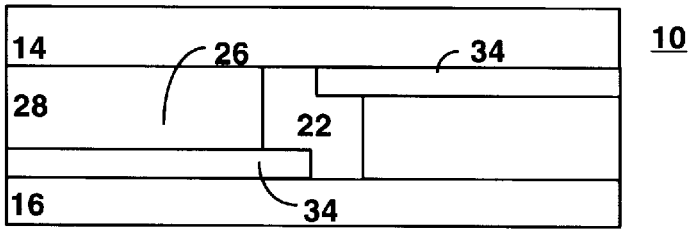
FIG. 5D is a cross-sectional view of a second embodiment of a dam.

A second embodiment of the dam 34 is depicted in FIG. 5D. In this embodiment the dam 34 is split into two portions. One of the portions extends from adjacent the chip layer 16 toward, but not to, the nozzle layer 12, and the other portion extends from adjacent the nozzle layer 12 toward, but not to, the chip layer 16. As depicted in FIG. 5C, the gates 26 formed are equal in height to the width of the throats 22. In variations of this embodiment the dam 34 may be broken into more than two portions, with the portions interdigitated, or staggered, as to which layer, 14 or 16, they extend from, as described in more detail below.

Figure 5E:
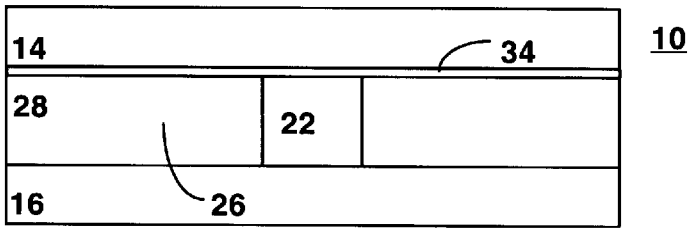
FIG. 5E is a cross-sectional view of a third embodiment of a dam.

In FIG. 5E there is depicted a third embodiment of the dam 34, in which the dam 34 extends from adjacent the nozzle layer 14 toward, but not to, the chip layer 16. In this embodiment the gate 26 that is formed between the bottom of the dam 34 and chip layer 16 is greater in height than the width of the throats 22. The height of gate 26 as shown in FIG. 5E is the distance from the dam 34 to the chip layer 16, and as before, the width of throat 22 is the horizontal dimension as shown in FIG. 5E.

Figure 5F:
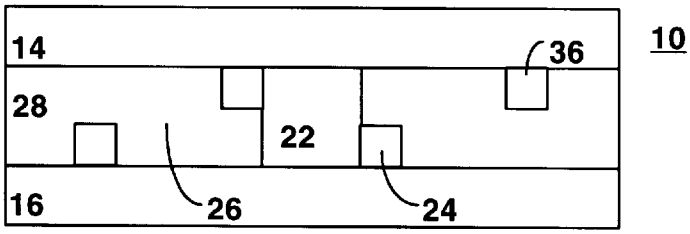
FIG. 5F is a cross-sectional view of interdigitated posts and pillars.

In FIG. 5F there is depicted yet another embodiment of the filter elements, which are formed by posts 24 and pillars 36. While posts 24 may extend from either the chip layer 16 or the nozzle layer 14, as described above, when filter elements extend from both the chip layer 16 and the nozzle layer 14, one set is called posts 24 and the other set is called pillars 36. In this embodiment, the posts 24 and the pillars 36 are interdigitated with a spacing of one post 24 between two adjacent pillars 36. However, it will be appreciated that other methods of interdigitation, such as two posts 24 between two adjacent pillars 36, may be used with equal application.

In this embodiment, the gates 26 which are formed between the posts 24 and the pillars 36 have a width that is equal to the width of the throats 22. As before, the width of the gates 26 may also be greater than the width of the throats 22.

While posts 24 or dam 34 may extend from adjacent either the chip layer 16 or the nozzle layer 14, in the preferred embodiment they extend from adjacent the chip layer 16. When such is the case, the posts 24 or dam 34 may then be formed from the material of the barrier layer 28, at the same time as the throats 22 and bubble chambers 20 are formed, and using the same methods. Thus, minimal, and preferably negligible, additional effort or cost need be expended to form the posts 24 or dam 34. When posts 24, dam 34, or pillars 36 extend from adjacent the nozzle layer 14, then the posts 24, dam 34, or pillars 36 are preferably formed from something other than barrier layer 28, though they may be formed of material that is the same as that which is used to form barrier layer 28.

In the embodiment such as is depicted in FIG. 2B, the posts 24, or pillars 36 as the case may be, which extend from the barrier layer 28, and barrier layer 28 and nozzle layer 14 may all be integrally formed of a single piece of material.

It is also preferable in all embodiments that the total cross-sectional area of the gates 26 be equal to or greater than the summed cross-sectional areas of the throats 22. When this is the case, debris that is caught by the filter elements and blocks gates 26 will not unduly inhibit the flow of ink through the throats 22 which is required for proper operation of the printhead 10. While a point may come, if there is an excessive amount of debris in the ink, when the flow of ink is inhibited to such an extent that proper operation of the printhead 10 is inhibited, having more cross-sectional area in the gates 26 than in the throats 22 will increase the amount of debris that can be caught by the filter elements before such an event occurs.

While specific embodiments of the invention have been described with particularity above, it will be appreciated that the invention is equally applicable to numberless adaptations well known to those skilled in the art.

What is claimed is:

1. An ink jet printhead, comprising:

a chip layer, forming a via for receiving ink and having at least one actuator for energizing the ink;

a barrier layer disposed adjacent to and overlying the chip layer, forming at least one throat having a width and a cross-sectional area, and at least one bubble chamber, the at least one throat adapted to receive the ink from the via and provide it to the at least one bubble chamber;

a nozzle layer disposed adjacent to and overlying the barrier layer, opposite the chip layer, forming at least one nozzle for ejecting the ink from the at least one bubble chamber when the ink is energized by the actuator, at least one post, pillar, or dam disposed proximate but not within the at least one throat, between the via and the at least one throat, extending part way between the chip layer and the nozzle layer, wherein the at least one post, pillar, or dam defines at least one gate through which the ink must pass from the via to the at least one throat, and wherein each of the at least one gate has at least one of a width or a height that is equal to or wider than the width of the at least one throat and wherein debris in the ink is effectively repelled or stopped by the posts, pillars, or dams.

2. The ink jet printhead of claim 1, wherein a summed cross-sectional area of all of the at least one gate is equal to a sum of the cross-sectional area of all of the at least one throat.

3. The ink jet printhead of claim 1, comprising a plurality of gates having a summed cross-sectional area that is greater than a sum of the cross-sectional area of all of the at least one throat.

4. The ink jet printhead of claim 1, wherein the at least one post, pillar, or dam extends from adjacent the chip layer toward, but not to, the nozzle layer.

5. The ink jet printhead of claim 1, wherein the at least one post, pillar, or dam extends from adjacent the nozzle layer toward, but not to, the chip layer.

6. The ink jet print head of claim 1 further comprising:

posts extending from adjacent the chip layer, and pillars disposed proximate the at least one throat, extending from adjacent the nozzle layer toward, but not to, the chip layer, the pillars interdigitated with the posts.

* * * * *